United States Patent [19]

Larmit

[11] 3,978,896

[45] Sept. 7, 1976

[54] WEFT THREAD INSERTING NOZZLE

[76] Inventor: Adrianus Johannes Franciscus Larmit, Rootven 12, Moergestel, Netherlands

[22] Filed: May 21, 1975

[21] Appl. No.: 579,696

[30] Foreign Application Priority Data

May 21, 1974 Netherlands ..... 7406857

[52] U.S. Cl. ..... 139/435; 226/97; 239/590.3

[51] Int. Cl.[2] ..... D03D 47/30; D03D 47/32

[58] Field of Search ..... 139/127 P, 127 R, 1 C, 139/435; 226/7, 95, 97; 239/590.3, 590.5

[56] References Cited

UNITED STATES PATENTS

| | | | |
|---|---|---|---|
| 2,238,360 | 4/1941 | Forster | 239/590.3 |
| 2,873,142 | 2/1959 | Zetterstrum | 239/590.3 |
| 3,037,710 | 6/1962 | Kusznier | 239/590.3 X |
| 3,124,167 | 3/1964 | Te Strake | 139/127 P |
| 3,672,406 | 6/1972 | Vermeulen | 139/127 P |
| 3,705,608 | 12/1972 | Vermeulen | 139/127 P |
| 3,847,187 | 11/1974 | Buran et al. | 139/127 P |

FOREIGN PATENTS OR APPLICATIONS

| | | | |
|---|---|---|---|
| 733,791 | 5/1966 | Canada | 139/127 P |
| 1,261,463 | 4/1961 | France | 139/127 P |

*Primary Examiner*—James Kee Chi
*Attorney, Agent, or Firm*—Marshall & Yeasting

[57] ABSTRACT

A weft thread inserting nozzle, comprising a hollow needle, having a closed tip at one end and the other end of which is adapted to be connected to a source of pressurized fluid, an outlet opening being provided in the side wall of the needle adjacent the tip, wherein said outlet opening is composed of a plurality of closely adjacent elementary apertures of smaller diameter.

2 Claims, 3 Drawing Figures

FIG. 1
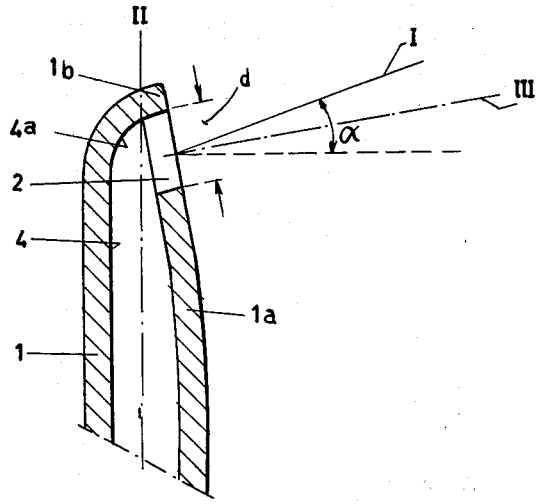
FIG. 2
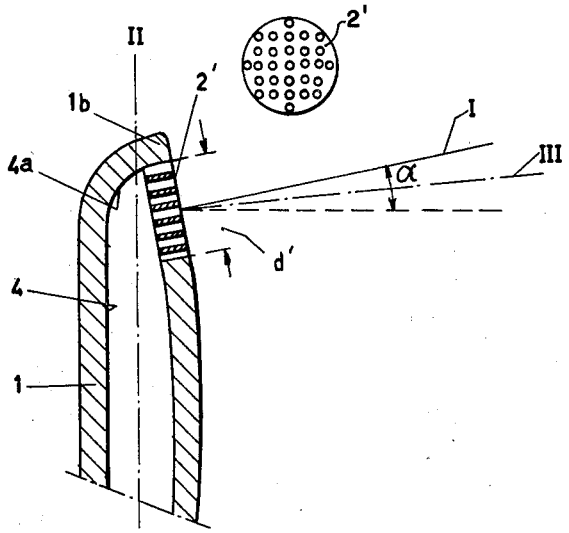
FIG. 3

WEFT THREAD INSERTING NOZZLE

BACKGROUND OF THE INVENTION

The invention relates to a weft thread inserting nozzle, comprising a hollow needle, having a closed tip at one end and the other end of which is adapted to be connected to a source of pressurized fluid, an outlet opening being provided in the side wall adjacent the tip.

Nozzles of this type are used in shuttleless looms and are located serially from one end of the weaving shed to the other so as to produce a consecutively a plurality of fluid jets, each of which is operative in a predetermined range of the weft inserting trajectory and "carries" the weft thread through the weaving shed.

Because of the needle-shape of said nozzles they may readily pass between the warp threads into and out of the weaving shed. Usually the nozzles project their jets into a guide tunnel formed within the weaving shed by the generally U-shaped blades of the reed or by a separate comb-like member which is periodically moved into and out of the weaving shed along with the nozzles.

A measure for the speed at which a weft thread may thus be transported through the weaving shed is constituted by the jet speed. A further determining factor is the direction of the fluid jets issuing from the individual nozzles. There is a certain direction of the fluid jets, at which the transmission of the kinetic energy from the jet to the thread to be inserted is optimal. When the direction of a jet deviates from said optimum direction the transmission of the kinetic energy from the jet to the thread becomes less effective, as a result of which stagnation (i.e. weaving defects) may occur. The rate of flow of fluid and thereby the speed of the carrying fluid in the tunnel may in principle be increased by increasing the fluid pressure and the cross-section of the outlet opening of the nozzle. An increase of the cross-section of the outlet opening, however, entails more uncertainty with respect to the correctness of the direction of the fluid jet. Further the direction of the issuing jet strongly depends on the pressure so that with variations in pressure the jet direction will vary as well.

SUMMARY OF THE INVENTION

Now the invention provides for a quicker weft thread transportation through the weaving shed by using nozzles of the type above referred to, in which according to the invention, the outlet opening is composed of a plurality of closely adjacent elementary apertures of smaller diameter. Such a "composite" outlet opening may be considered as an opening having partitions dividing the fluid flow supplied from the interior of the needle into a plurality of separate jets which, as experiments have shown, re-unite to a single coherent jet at a very short distance in front of the outlet opening, or in any case behave as such.

It has been found that the exact direction of a liquid or gas jet supplied through such a composite outlet opening is predictable for substantially larger total cross-sections, namely remains practically coincident with the axis of the opening. Thereby on the one hand a larger total cross-section of the elementary apertures may be employed so that a given speed may be realized with a substantially lower feed pressure and at the same time the pressure sensitivity is substantially decreased. Moreover, with a given feed pressure and therefore with a given pressure gradient, higher air velocities, thereby higher weft speeds may be obtained.

Further it has been found that an outlet opening constructed in the manner according to the invention is — with respect to the direction of the issuing gas or liquid jet — substantially less sensitive to inaccuracies in the exterior transitional portion extending between the inner wall of the passage through the hollow needle and the circumferential wall of the outlet aperture.

BRIEF DESCRIPTION OF THE DRAWINGS

FIG. 1 is a longitudinal section on an enlarged scale through a needle-like weft inserting nozzle of a well-known construction.

FIG. 2 is a similar section through a nozzle according to the present invention.

FIG. 3 is an elevation of the discharge outlet of the nozzle.

The prior art nozzle as shown in FIG. 1 comprises a hollow needle 1 which is provided with a single aperture 2 in its side wall 1a adjacent to the closed "tip" 1*b*. The angle between the axis I of the liquid or gas jet issuing through the aperture 2 and the perpendicular to the longitudinal axis II of the nozzle is indicated by $\alpha$. In practice the direction of the axis I deviates more or less from the axis III of the aperture 2, dependent on the diameter *d* of that aperture and also on the accuracy of the transition portion 4*a* of the inner wal 4 leading towards leading the circumferential wall of the aperture 2.

In the embodiment according to the invention as shown in FIG. 2 an outlet 2' is composed of a plurality of elementary apertures. The elementary apertures are located closely adjacent each other, which means that the thickness of the partitions between the elementary apertures does not materially exceed the diameter of the elementary apertures. Again $\alpha$ denotes the angle between the axis I of the issuing liquid or gas jet and the perpendicular to the longitudinal axis II of the nozzle.

An outlet opening comprising a plurality of elementary apertures like that of FIG. 2 may e.g. be obtained be means of electro-erosion.

The nozzle according to the invention may be connected in known manner at its end remote from the tip to a feed conduit which is constantly outside the weaving shed and may, if desirable, be integrally formed with one or more of the blades which together form a guide tunnel through the weaving shed of a weaving machine.

I claim:

1. A nozzle adapted to be inserted between warp threads into a weaving shed, for discharging a jet of fluid to propel a weft thread at a high speed through a tunnel formed in the weaving shed, comprising a hollow needle for conducting a fluid under pressure having a discharge outlet in the side wall of the needle, adjacent to the tip of the needle, characterized in that said discharge outlet is composed of a plurality of closely spaced elementary apertures.

2. A nozzle according to claim 1, wherein the spacing between the apertures does not materially exceed the aperture diameter.

* * * * *